US009278842B2

(12) United States Patent
Angerer

(10) Patent No.: US 9,278,842 B2
(45) Date of Patent: Mar. 8, 2016

(54) METHOD FOR THE CONTROL OF A FILLING MACHINE

(71) Applicant: KRONES AG, Neutraubling (DE)

(72) Inventor: Florian Angerer, Suenching (DE)

(73) Assignee: Krones AG, Neutraubling (DE)

( * ) Notice: Subject to any disclaimer, the term of this patent is extended or adjusted under 35 U.S.C. 154(b) by 80 days.

(21) Appl. No.: 13/856,275

(22) Filed: Apr. 3, 2013

(65) Prior Publication Data

US 2013/0284307 A1 Oct. 31, 2013

(30) Foreign Application Priority Data

Apr. 4, 2012 (DE) ..... 10 2012 102 965

(51) Int. Cl.
*B67C 3/28* (2006.01)
*B65B 3/30* (2006.01)

(52) U.S. Cl.
CPC .. *B67C 3/288* (2013.01); *B65B 3/30* (2013.01)

(58) Field of Classification Search
CPC ..... B67C 3/288
USPC ..... 141/2, 83, 196, 198, 94–95
See application file for complete search history.

(56) References Cited

U.S. PATENT DOCUMENTS

| | | | |
|---|---|---|---|
| 4,386,635 A | 6/1983 | Ahlers et al. | |
| 4,691,496 A | 9/1987 | Anderson et al. | |
| 5,148,841 A | 9/1992 | Graffin | |
| 5,273,082 A | 12/1993 | Paasche et al. | |
| 8,701,719 B2 * | 4/2014 | Clusserath | 141/9 |
| 2009/0159150 A1 | 6/2009 | Lorenz et al. | |
| 2010/0192521 A1 | 8/2010 | Clüsserath | |

FOREIGN PATENT DOCUMENTS

| | | |
|---|---|---|
| CN | 101479182 A | 7/2009 |
| CN | 101652315 A | 2/2010 |
| CN | 102131595 A | 7/2011 |
| DE | 41 17 287 A1 | 12/1992 |
| DE | 690 00 764 T2 | 5/1993 |
| DE | 10 2006 029 490 B4 | 4/2008 |
| DE | 10 2007 030 559 A1 | 1/2009 |
| EP | 0 515 960 A1 | 12/1992 |
| EP | 1 447 329 B1 | 12/2008 |

(Continued)

OTHER PUBLICATIONS

Official English Translation of JP2000-128283 entitled "Filling Apparatus with Measurement Function", Schreiber Translations, Inc., Nov. 2014.*

(Continued)

*Primary Examiner* — Timothy L Maust
*Assistant Examiner* — Timothy P Kelly
(74) *Attorney, Agent, or Firm* — Lewis Roca Rothgerber Christie LLP

(57) ABSTRACT

The present invention relates to a method for the control of a filling machine (A) for the filling of containers (C) with liquid filling material, wherein the filling machine comprises at least two controllable filling elements (1, 2, 30, 31) each having at least one filling sensor, and wherein by way of the filling sensors the termination of filling of the respective filling element is controlled. According to the invention a first filling element (1) will, in case of failure of its filling sensor, be controlled synchronously to a following second filling element (2).

6 Claims, 2 Drawing Sheets

(56) References Cited

FOREIGN PATENT DOCUMENTS

| | | | |
|---|---|---|---|
| GB | 2 072 380 | A | 9/1981 |
| JP | 2000-128283 | A | 5/2000 |
| WO | WO 2005/080202 | A1 | 9/2005 |

OTHER PUBLICATIONS

Examination Report issued in the parallel Chinese patent application No. 201310118073.6, issued Aug. 26, 2014 (5 pages), and English translation (5 pages).

* cited by examiner

METHOD FOR THE CONTROL OF A FILLING MACHINE

CROSS-REFERENCE TO RELATED APPLICATION(S)

This subject application claims priority to and the benefit of German Patent Application Number DE 10 2012 102 965.2, filed on Apr. 4, 2012, the entire disclosure of which is incorporated herein by reference.

BACKGROUND OF THE INVENTION

1. Field of the Invention

The present invention relates to a method for the control of a filling machine for the filling of containers with liquid filling material, preferably for the control of a rotary filler for the filling of beverage containers with beverages.

2. Description of Related Art

Filling machines and especially rotary fillers for the filling of liquid filling material into containers are well known in the prior art. Known filling machines typically comprise filling elements through which the liquid filling material is passed to reach the respective containers to be filled. Usually the respective filling process is started at a specified machine position, i.e. at the start of the filling angle, and is terminated upon reaching a specified final condition. The final condition for the filling process may for example be a filling quantity, a filling weight or a filling level to be reached in the respective container. By means of an appropriate filling sensor this final condition is monitored. If the final condition will not be reached before the end of the filling angle the filling method is necessarily terminated upon reaching the end of the filling angle.

During the actual filling process the filling element may provide different flow rates which are controlled according to a specified routine. For example, to avoid excessive foaming, a lower flow may be provided at the beginning of the filling process. During an intermediate period maximal flow may then be provided to accomplish rapid filling of the container. Upon reaching the end of the filling process reduced flow rate may in turn be provided to facilitate exact filling of the container and reaching the final condition without any problems.

The filling sensor for the detection of the presence of the final condition is for example given in form of a flow sensor for the determination of the flow rate of the liquid filling material through the filling element, a weight sensor or a weighing cell for the determination of the filling weight of the liquid filling material in the container, a back pressure sensor in a Pitot tube or a short circuit sensor on a probe for the determination of a specified filling level in a container, or a volume sensor for the determination of the filling volume introduced into the container. Upon reaching the specified volume, the specified quantity, the specified weight and/or the specified filling level the filling element will be closed and the filling process for this container is terminated.

If such a filling sensor for the determination of filling termination of a filling element in a filling machine fails, filling termination may no longer be exactly determined. Overfilling of the container will result since the filling element will not terminate before the end of the filling angle, i.e. at a point in time which is specified by the machine position—independent of the proper filling state of the container. The resulting overfilled bottle is identified as a defective filling and must be eliminated from the system. Basically, in a rotary filler in each filling cycle such an overfilled container is generated so that the performance will significantly be compromised. Simultaneously, increased contamination of the filling machine by the overflow of the respective overfilled containers may occur.

In the known filling methods the problem of a defective filling sensor is solved by way of completely shutting down the affected filling element. In this way generation of overfilled containers is avoided. From shutting down the affected filling element, however, a loss of filling performance will result since with each filling element which is shut down filling performance will get lost. Furthermore, upon shutting down the affected filling element in each filling cycle an empty container is produced for each shut down filling element which as well has to be eliminated in the following quality control process.

From DE 10 2006 029 490 B4 it is known to measure the filling time required by an intact filling sensor and to control a filling element having a defective filling sensor on the basis of said identified filling time. In this way by using the filling time which was measured for an intact filling element the filling element with the defective filling sensor may still be operated. For this, the valve opening signal for the defective filling element must be delayed to accomplish opening and closing of the defective filling element in correspondence to the desired machine angle or the desired position within the filling machine, respectively.

The known method suffers from the fact that for obtaining measurement of the filling time of the intact filling element at least one revolution of the filling machine must be passed. Accordingly, upon occurrence of failure of a filling sensor at least two defectively filled containers are generated, i.e. a first defectively filled, overfilled container, allowing to assume failure of the filling sensor in the first place, and a second defectively filled container which either is also overfilled or which, having a shut down filling element, is underfilled accordingly, while the filling time of a filling element having an intact filling sensor is being determined.

BRIEF SUMMARY OF THE INVENTION

Accordingly, based on the prior art mentioned above it is an object of the present invention to provide an alternative method for the control of a filling machine for the filling of containers with liquid filling material.

This object is solved by way of a method having the features according to claim 1. Advantageous further developments arise from the dependent claims.

Accordingly, the filling machine in the method for the control of a filling machine for the filling of containers with liquid filling material comprises at least two controllable filling elements, each having at least one filling sensor. By way of the filling sensors the termination of filling of the respective filling elements is controlled. According to the invention, a first filling element is controlled synchronously to a following second filling element in case of failure of the filling sensor thereof.

Due to the fact that in case of failure of a filling sensor of a first filling element control of the filling element is taken over by a following second filling element, both filling elements will accordingly be operated synchronously to each other. The first filling element comprising the defective filling sensor opens exactly at the time when the second filling element opens. Analogously both filling elements also close synchronously. Also the other interposed possible control phases of the second filling element, for example phases of different flow rates, are executed synchronously by the first filling element which comprises the defective filling sensor.

The following filling element taking over control of the preceding filling element having the defective filling sensor may either be a filling element having intact filling sensor or a filling element which also includes a defective filling sensor. In the latter case this filling element having defective filling sensor in turn then is synchronized with a following filling element having an intact filling sensor. Accordingly cascading of filling elements having defective filling sensors is possible and the cascaded filling elements having defective filling sensors then will synchronously be operated by a single following filling element having an intact filling sensor.

In this way it may be accomplished that during the same machine revolution a filling element having an intact filling sensor will at least activate one preceding filling element having a defective filling sensor. Accordingly, conditions in the filling machine are essentially the same for the filling elements which are operated synchronously to each other. Especially the level in the reservoir vessel above which accommodates the liquid filling material is nearly identical for the filling elements which are controlled synchronously to each other such that the liquid column acting on the individual filling elements is also the same. Therefore it may be assumed that in the at least one filling element having a defective filling sensor a filling performance is achieved which is similar to the following filling element having an intact filling sensor.

Thus the filling element having a defective filling sensor may rejoin the filling process immediately after identification of the failure of the filling sensor so that preferably solely one single defectively filled container is produced, i.e. a container which is overfilled due to the failure of the filling sensor, which also serves for the identification of the failure of the filling sensor. Thereafter, the method herein proposed may immediately be implemented and the filling element having a defective filling sensor may be controlled synchronously to the following filling element.

By synchronously controlling the filling element having a defective filling sensor by way of a following filling element, a significantly simplified control may be accomplished which may be employed immediately following the identification of the failure of the filling sensor. Neither any timing nor any calculation of delays nor any application of conversion factors are required. Solely the control of the following filling element is synchronously and identically applied to the filling element having a defective filling sensor.

By way of controlling the filling element having a defective filling sensor synchronously to the following filling element, elaborate steps of calculation may be omitted. The control signals of the following filling element solely need to be directly used for the control of the filling element having a defective filling sensor. In this way very simple control in emergency mode is possible which also may be implemented in a simple and cost-effective manner.

Especially exact control may be accomplished in that the first filling element having a defective filling sensor is controlled synchronously to an immediately following second filling element. By using the immediately following filling element for synchronously controlling the filling element having a defective filling sensor, for the first filling element having a defective filling sensor only a small sector of the filling angle may not be used, i.e. a sector according to the machine pitch. Thus complete filling of the container may even be accomplished also with the first filling element having a defective filling sensor if the filling method does not start directly at the start of the filling angle. This, however, would not immediately be assured for example by the use of a filling element having an intact filling sensor significantly spaced apart from the filling element having a defective filling sensor since the defective filling element would then already be beyond the specified maximum filling angle before the filling process in the filling element having an intact filling sensor would be terminated.

Furthermore filling conditions for two directly adjacent filling elements are essentially the same such that exact filling may be accomplished.

Even with the presence of at least two successive filling elements each having a defective filling sensor these may be controlled synchronously to a following filling element having an intact filling sensor, preferably synchronously to a filling element immediately following. Accordingly herein at least three filling elements are controlled synchronously to each other. By way of such cascading of at least two filling elements having a defective filling sensor in synchronization with a following filling element having an intact filling sensor, even during failures of several filling sensors operation of the filling machine under full performance may be maintained. An advantage of this configuration of the invention also resides in that appropriate emergency operation may turned on directly following identification of the failure of the filling sensor and in this way only minor loss of performance for the detection of the actual failure of the filling sensor will occur, whereupon the filling machine may be operated with full performance.

It is especially preferred that the filling element having a defective filling sensor is controlled both regarding the beginning of the filling process and the termination of the filling in the filling process synchronously to the following filling element. In this way separate controlling of the filling process of the filling element having a defective filling sensor will completely be omitted so that control may significantly be simplified.

In a further preferred aspect a filling element having a defective filling sensor will further be controlled via control commands from a central filling machine control, besides the synchronous control of the filling process via the following filling element. In this way other control commands not relying on the data of the defective filling sensor may still be executed by the filling element. In other words, solely the opening and closing commands are transmitted by the following filling element and all other control commands which also are present for all other filling elements are taken over by the central control.

The presence of a failure of the filling sensor of a filling element will preferably be detected by a central filling machine control, the latter for example communicating with a container inspector to identify defectively filled containers. In a preferred embodiment the central control of the filling machine controls the filling element having a defective filling sensor automatically in a synchronous way with the following filling element. In this way also automated switching to emergency operation for the filling element having a defective filling sensor may occur, so that external manipulation will not be necessary.

In an alternative, control of the filling element having a defective filling sensor synchronously to the following filling element may manually be selected if a facility operator has detected a failure of a filling sensor of a filling element.

BRIEF DESCRIPTION OF THE DRAWINGS

Further preferred embodiments and aspects of the present invention are more fully explained by the description below of the figures. The figures show.

DETAILED DESCRIPTION OF THE INVENTION

Examples of preferred embodiments are described below with the aid of the figures. In the figures, elements which are identical or similar, or have identical effects, are designated with identical reference signs, and repeated description of these elements is in part dispensed with in the description below, in order to avoid redundancy.

Figure 1:
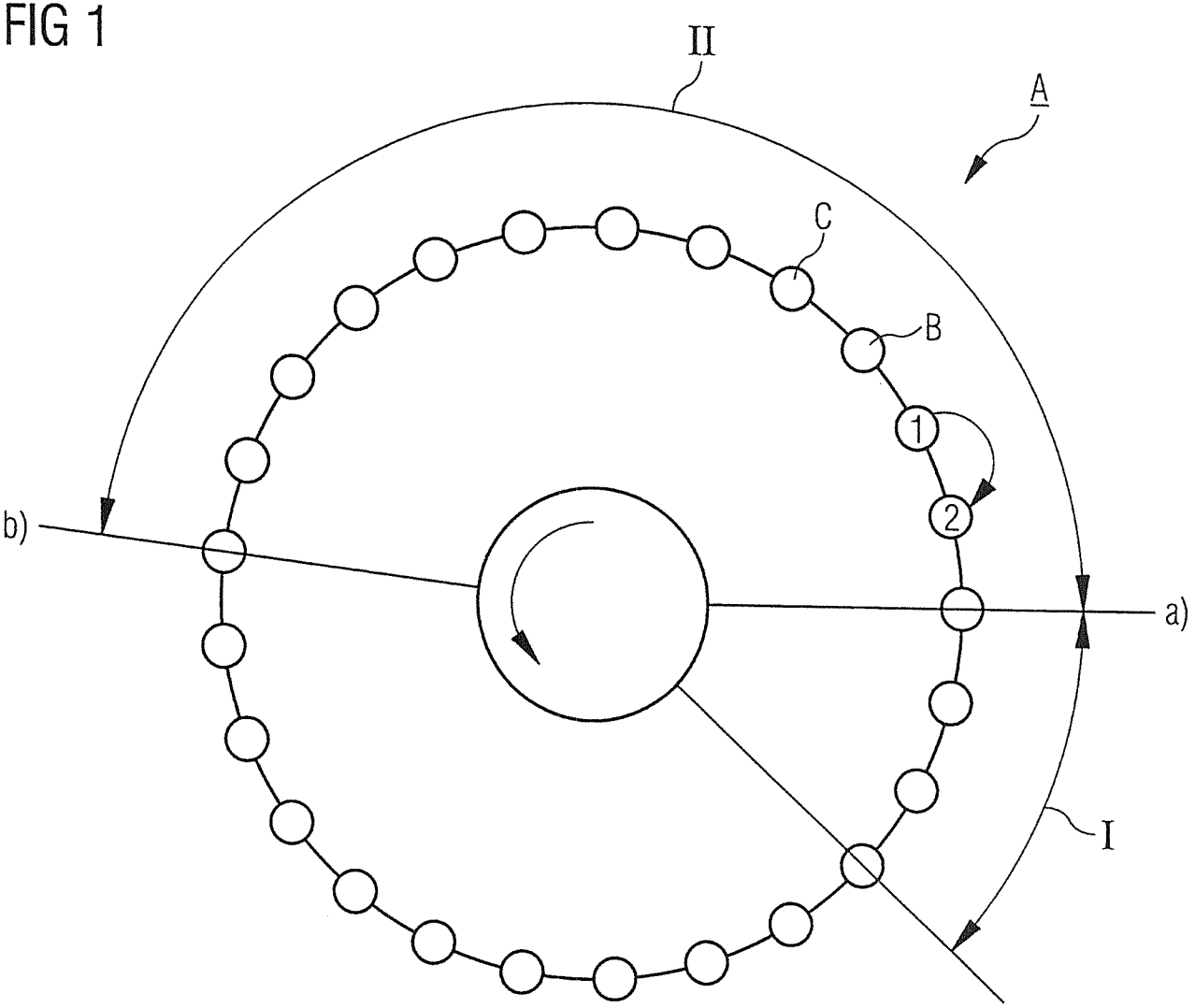
FIG. 1 a schematic top view of a rotary filler according to an embodiment in a first condition of the method, and FIG. 2 a top view of the rotary filler of FIG. 1 in a further condition of the method.

FIG. 1 is illustrating a filling machine A in the form of a rotary filler which accommodates suitable containers C to be filled along its circumference in pockets B.

Accordingly, on the pitch circle of the rotary filler A the containers C to be filled are transported. Via a star wheel (not shown herein) the containers C are fed for example in a first process angle, which is identified by I in FIG. 1, and the respective filling elements are arranged above the respective containers in a filling position. The filling elements are located above the respective containers C and are identified by the numbers 1, 2, 30 and 31 in the figures.

Depending on the liquid filling material to be filled herein either open jet filling valves or filling valves onto which the respective containers C need to be pressed are used. In the first case of an open jet filling machine typically a weighing cell is used, arranged below the container for identification of the respective termination of the filling. The oscillation of this weighing cell may settle over the process angle I and may become leveled such that the filling process may reliably be monitored. In an alternative in an open jet filling valve for example, also a specified filling level may be determined by way of a probe, or by way of a flow meter or of a volume sensor a target volume may be used as a condition for terminating the filling process.

In case of a filling element which has to be pressed onto the respective container, pressing the filling element onto the container C across the process angle I may be realized.

Across the process angle II which corresponds to the maximum filling angle, the liquid filling material may now be filled into the respective container C via the appropriate filling element. To achieve this, the appropriate filling element is opened at the beginning of the filling phase at the machine position a) to start the filling process. The filling element is closed again if the appropriate filling sensor for the determination of the termination of filling, i.e. for example a weighing cell, a flow meter, a volume meter, a Pitot tube, or a short circuit probe, is signaling that the specified final condition has been reached, i.e. for example when the specified filling volume, the predetermined filling weight, the predetermined quantity of the liquid filling material or the predetermined filling level in the respective container C has been reached.

Different phases may be passed during the filling process across the process angle II. Thus, at the beginning of the filling process the filling element typically will only be opened in a reduced manner, in order to—depending of the liquid filling material to be filled—avoid excessive foaming in the container C. Following this, the filling element may be opened completely to promote rapid filling. Towards the end of the filling process the filling velocity is preferably reduced to allow exact reaching of the final condition.

Towards the end of the filling angle at the machine position b) the filling element in any case is closed to allow discharge of the filled containers.

In a case wherein a filling sensor of a filling element is detected as defective, such as for example the filling element which in FIG. 1 is identified by 1, this filling element is switched to emergency operation. Accordingly, this filling element 1 having a defective filling sensor now will synchronously be controlled via the following filling element 2. In other words the respective filling elements 1 and 2 now are actuated synchronously to each other.

Accordingly, the defective filling element 1 will not open at the beginning of the filling phase, i.e. at the machine position a), but only if the following filling element 2 which has an intact filling sensor has reached position a). Both filling elements 1 and 2 will then open synchronously to each other. Accordingly the filling element 1 having a defective filling sensor will lose part of the filling angle II which in the example shown, however, solely has the order of magnitude of a machine pitch.

Accordingly, the filling element 1 having a defective filling sensor will synchronously and identically run through all phases of the filling process of the following filling element 2, for example phases of a reduced volume flow and phases of an increased volume flow.

Switching from regular operation to emergency operation according to the method of the present invention may be achieved immediately when failure of the filling sensor of the filling element 1 has been identified. The switching may be done in an automated way, for example by way of the central control of the filling machine, or manually.

By way of synchronous controlling the filling element, extensive timing or calculations may completely be omitted. Solely the control signals of the following filling element 2 will identically and synchronously be taken over for the filling element 1 having a defective filling sensor.

Due to the fact that the following filling element 2 serves to control the immediately preceding filling element 1 having a defective filling sensor it may further be assured that the filling process will essentially be completed until the end of the filling angle II and that, accordingly, container C located below the filling element 1 will pass all phases of the filling process which also have been passed by the following filling element 2. In case that the filling process for the following filling element 2 should not be completed until the end of the filling angle at the machine position b), only minor underfilling of the container C at the filling element 1 having a defective filling sensor will occur since here solely one machine pitch of filling time is lost. Typically, however, the filling process is completed before the end of the filling angle II at the machine position b) so that also the filling element 1 preceding the filling element 2 has already terminated filling of the container C upon reaching the end of the filling angle II at the machine position b).

If further control commands are emitted by a central control of the filling machine these may also be realized by filling element 1. Only controlling the filling process is taken over by the following filling element 2.

Figure 2:
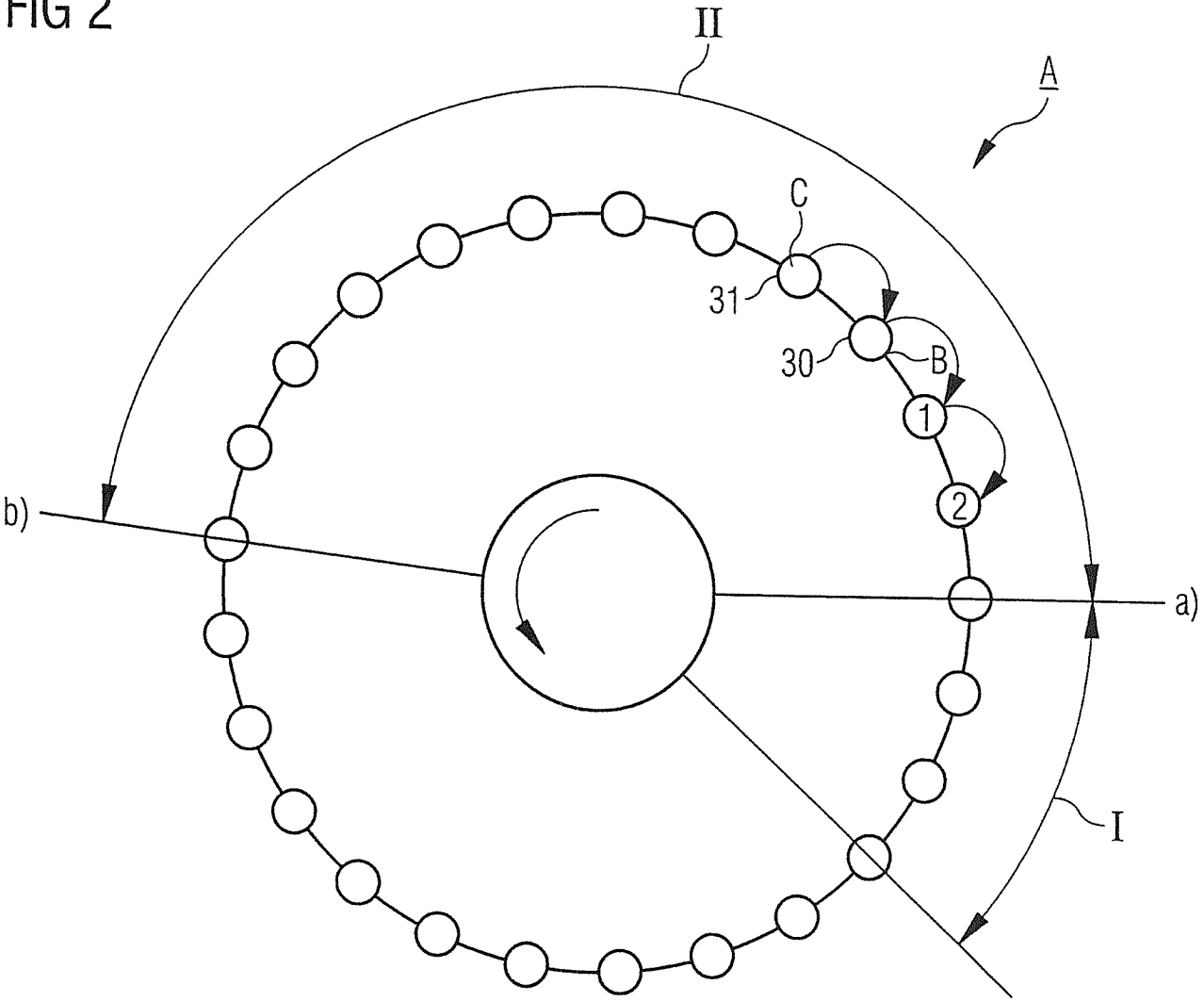

FIG. 2 illustrates the filling machine A in a further operative state in which within the filling angle II malfunction of further filling sensors of adjacent filling elements has occurred. In the examples illustrated above for example malfunction of the filling sensors of the filling elements 31, 30 and 1 is shown.

In this case it is preferred that synchronous control of the individual filling elements 31, 30 and 1 having defective filling sensors is realized again by the respective following filling element.

The individual defective filling elements 31, 30 and 1 are thereby cascaded such that initially the filling element 1 having a defective filling sensor is controlled synchronously to the following filling element 2 having an intact filling sensor. The filling element 30 having a defective filling sensor is controlled by the following filling element 1 (having a defective filling sensor) which—as explained above—is operated synchronously to the following filling element 2. In an analogous manner also the filling element 31 having a defective filling sensor is operated synchronously to the following filling element 30 (also having a defective filling sensor). In other words the filling elements 1, 2, 30 and 31 in this condition open and close synchronously.

Accordingly, a simplification results in that a defective filling element in the illustrated emergency operation will always be operated based on the following filling element. Synchronous control is provided for each of the following filling elements. If the following filling element has a defective filling sensor, both filling elements having defective filling sensors are operated synchronously to each other. Each one of the defective filling elements is then followed by a filling element having an intact filling sensor which accordingly serves for the cascaded control of all preceding defective filling elements and which are connected to each other.

Such cascading would only end if the first defective filling element within the filling angle II would only pass as little of the filling angle as resulting in an under-filled container. Such a filling element then would need to be completely shut down. Accordingly the theoretically unlimited cascading of defective filling elements is limited by the maximum filling angle possible in combination with the maximum flow rate possible by the intact filling element.

To the extent applicable, all individual features described in the individual example embodiments can be combined with each other and/or exchanged, without departing from the scope of the invention.

LIST OF REFERENCE NUMERALS

A filling machine
B pocket
C container
I process angle for taking over containers
II filling angle
a) start of filling angle
b) end of filling angle

The invention claimed is:

1. A method for the control of a filling machine for filling containers with a liquid filling material, wherein the filling machine comprises at least two controllable filling elements each having at least one filling sensor, the method comprising:

controlling a termination of filling of the filling elements via the at least one filling sensor, monitoring the at least one sensor of each of the filling elements for defectiveness; and synchronously controlling a first filling element and an adjacent second filling element such that, within a single filling machine revolution, if the at least one sensor of the first filling element is defective, the at least one filling sensor of the second filling element activates the first filling element.

2. The method according to claim 1, wherein the second filling element controls both a beginning of a filling process and a termination of the filling process synchronously when at least one of the filling elements has a defective filling sensor.

3. The method according to claim 1, wherein when the first filling element has a defective filling sensor, the first filling element is also controlled by way of control commands from a central control of the filling machine.

4. The method according to claim 1, wherein a central control of the filling machine is configured to detect a failure of the at least one filling sensor.

5. The method according to claim 4, wherein the central control of the filling machine is configured to automatically control the first filling element having the defective filling sensor by synchronously using the second filling element.

6. The method according to claim 4, comprising manually controlling the filling elements having the defective filling sensor synchronously via the second filling element.

* * * * *